United States Patent [19]

Reinhardt et al.

[11] Patent Number: 4,773,911

[45] Date of Patent: Sep. 27, 1988

[54] OXIDATION PROCESS TO DECREASE FREE FORMALDEHYDE IN DURABLE PRESS FINISHING WITH CARBAMATE AGENTS

[75] Inventors: Robert M. Reinhardt; Bethlehem K. Andrews, both of New Orleans, La.

[73] Assignee: The United States of America as represented by the Secretary of Agriculature, Washington, D.C.

[21] Appl. No.: 68,498

[22] Filed: Jul. 1, 1987

[51] Int. Cl.[4] ..... C07C 125/065; D06M 13/38

[52] U.S. Cl. ..... 8/187; 560/160; 560/166

[58] Field of Search ..... 560/160, 166; 8/187

[56] References Cited

U.S. PATENT DOCUMENTS

| | | |
|---|---|---|
| 3,597,380 | 8/1971 | Bertini et al. . |
| 3,723,377 | 3/1973 | Spangler . |
| 3,749,751 | 7/1973 | Pai . |
| 4,488,878 | 12/1984 | Andrews et al. . |

OTHER PUBLICATIONS

Reid et al., *American Dyestuff Reporter,* vol. 59, No. 5, p. 26, Jun. 1970.

Frick and Reinhardt, *American Dyestuff Reporter,* vol. 56, No. 9, p. 41, Apr. 1967.

Wayland et al., *Textile Research Journal,* vol. 51, No. 4, p. 302, Apr. 1981.

Andrews et al., *Textile Chemist and Colorist,* vol. 12, No. 11, p. 287, Nov. 1980.

*Primary Examiner*—James C. Cannon

*Attorney, Agent, or Firm*—M. Howard Silverstein; John D. Fado

[57] ABSTRACT

Methods for lowering the free formaldehyde release in carbamate durable press treatment solution and finished fabric are disclosed. Concentrated carbamate finishing agent solution of lowered free formaldehyde content comprises oxidizing a carbamate finishing agent solution containing free formaldehyde with a sufficient amount of magnesium monoperoxyphthalate oxidant to decrease the free formaldehyde content of the solution. Sufficient amount of catalyst is added to this solution to produce press properties in cellulose containing fabric to make a treatment bath. Cellulose containing fabric is immersed in this bath for sufficient time and temperature to produce lowered free formaldehyde release carbamate durable press finished fabric. High free formaldehyde carbamate-finished durable press cellulose containing fabric can be treated with a solution of magnesium monoperoxyphthalate oxidant of sufficient concentration for sufficient time and temperature to oxidize the free formaldehyde and thereby produce a lowered free formaldehyde release carbamate durable press finished fabric.

14 Claims, No Drawings

OXIDATION PROCESS TO DECREASE FREE FORMALDEHYDE IN DURABLE PRESS FINISHING WITH CARBAMATE AGENTS

BACKGROUND OF THE INVENTION

1. Field of the Invention

This invention relates to low formaldehyde durable press finishes.

2. Description of the Prior Art

Carbamate based finishing agents are used in the textile industry for producing durable press fabrics which require high degrees of durability of finish and white fastness. Such finishes are relatively resistant to acidic and alkaline hydrolysis and therefore the finished fabrics have a more durable smooth-drying appearance than fabrics finished with other traditionally used finishing agents such as dimethyloldihydroxyethyleneurea (DMDHEU) or dimethylolethyleneurea (DMEU).

Two major deterrents to more widespread use of carbamate based agents are (1) high free formaldehyde content of solutions of the reagent and (2) high formaldehyde release characteristics of the dried or sensitized fabrics that have been treated with the agent and of the nonwashed, cured fabric (Reid et al., American Dyestuff Reporter, Vol. 59, No. 5, p. 26, June 1970). For economic reasons, finished fabrics are rarely washed at the finishing plant prior to shipment to the garment manufacturer, retailer, or consumer. Hence, workers and users of these nonwashed carbamate-finished fabrics may be exposed to high levels of free formaldehyde and formaldehyde release.

Previously, some of these high formaldehyde release levels were lowered by reducing the ratio of formaldehyde to carbamate from greater than 2:1 to 2:1 or less in reagent preparation, and by addition of formaldehyde scavengers to the crosslinking agent solution (Frick and Reinhardt, American Dyestuff Reporter, Vol. 56, No. 9, p. 41, April 1976; U. S. Pat. Nos. 3,597,380; 3,749,751; 3,723,377). These remedial measures lowered formaldehyde release in finished fabrics to a level lower than that from fabric finished with a carbamate reactant prepared from more than 2 moles of formaldehyde per mole of carbamate, but higher than that from a finish from currently used DMDHEU reactant (Wayland et al., Textile Research Journal, Vol. 51, No. 4, p. 302, April 1981).

Two other means of producing low formaldehyde release carbamate finishes are: inclusion of a glycol in the finishing bath (Andrews et al., Textile Chemist and Colorist, Vo. 12, No. 11, p. 287, November 1980); and etherification of hydroxymethylated carbamates prior to application to fabric (Andrews and Reinhardt, U.S. Pat. No. 4,488,878). However, these procedures do not remove the formaldehyde and produce high levels of free or releasable formaldehyde from both treatment solution and dried but not cured fabrics.

SUMMARY OF THE INVENTION

The following processes are disclosed: (1) a method for producing a concentrated carbamate finishing agent solution of lowered free formaldehyde content: (2) a method for producing a lowered free formaldehyde carbamate durable press finishing treatment bath for cellulose containing fabric; (3) a method for producing a carbamate-finished durable press, low formaldehyde release cellulose containing fabric and the product therefrom; (4) a method for reducing the free formaldehyde in a high free formaldehyde carbamate-finished durable press cellulose containing fabric and the product therefrom.

The method for producing the concentrated carbamate finishing agent solution of lowered free formaldehyde content comprises oxidizing a carbamate finishing agent solution containing free formaldehyde with a sufficient amount of magnesium monoperoxyphthalate oxidant to decrease the free formaldehyde content of the solution. The lowered free formaldehyde carbamate durable press finishing treatment bath for cellulose containing fabric is produced by adding a sufficient amount of durable press catalyst to the foregoing solution to produce durable press properties in cellulose containing fabric. Durable press properties on cellulose containing fabric from a carbamate durable press, low formaldehyde release finish are produced by immersing the cellulose containing fabric in the above treatment bath and drying and curing the fabric for sufficient time and temperature to produce a lowered free formaldehyde release carbamate durable press finished fabric. High free formaldehyde carbamate-finished durable press cellulose containing fabric can be treated with a solution of magnesium monoperoxyphthalate oxidant of sufficient concentration for sufficient time and temperature to oxidize the free formaldehyde and thereby produce a lowered free formaldehyde release carbamate durable press finished fabric.

DESCRIPTION OF THE PREFERRED EMBODIMENTS

Hydroxymethylated derivatives of carbamates (often called by their trivial names such as dimethylol methyl carbamate, dimethylol isopropyl carbamate and the like) are well known as durable press finishing agents for cellulosic textiles; therefore abundant literature is available for preparation of these derivatives. Included in the hydroxymethylated carbamate class of compounds are alkyl bis(hydroxymethyl)carbamates with the alkyl moiety containing one to six carbons, such as methyl, ethyl, n-propyl, isopropyl, n-butyl, and isobutyl; and alkoxyalkyl bis(hydroxymethyl)carbamates with an alkoxyalkyl moiety such as methoxyethyl and the like. Published descriptions of these carbamates, their preparations, and their usefulness as textile finishing agents may be found in the review "Carbamate Textile Finishing Agents" in Colourage Annual 1971, p. 19–27.

Other carbamate derivatives that are efficient durable press finishing agents for cellulose are the alkoxymethylated and hydroxyethoxymethylated carbamates. These agents, their preparation, and their use for finishing cellulosic textiles are fully described in U.S. Pat. Nos. 4,488,878 and 4.539,008. They may be used in the preferred embodiments of this invention. Prominent among this group of agents are methyl bis(methoxymethyl)carbamate, isopropyl bis(methoxymethyl)carbamate, isobutyl bis(methoxymethyl)carbamate, and methoxyethyl bis(methoxymethyl)carbamate; methyl bis(hydroxyethoxymethyl) carbamate, isopropyl bis(hydroxyethoxymethyl)carbamate, isobutyl bis(hydroxyethoxymethyl)carbamate and methyoxyethyl bis(hydroxyethoxymethyl)carbamate. Hydroxymethylated carbamate agents that are methylated or hydroxyethylated to less than the full degree also may be employed.

Solutions of carbamate finishing agents always contain free formaldehyde in an amount that can vary from very low to concentrations that are obnoxious and potentially dangerous. Common thinking in the textile finishing industry is that carbamate agents contain more free formaldehyde than is desirable for most expeditious usage.

In the preferred embodiments the free formaldehyde in solutions of carbamate agents of the various types described above is decreased to low levels or to almost nil by oxidation of the contained free formaldehyde by use of magnesium monoperoxyphthalate. Magnesium monoperoxyphthalate is an organic peroxyacid of the formula:

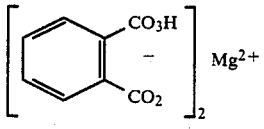

It is readily available commercially. For example, one source is Interox America, Houston, Tex. which furnishes the compound as the hexahydrate under their product name Interox H48. This product is a solid and is rapidly soluble in cold water. It is a strong oxidizing agent that may be considered to be substantially more active than alkaline hydrogen peroxide, or three to five times stronger than sodium perborate by weight. The commercial product furnishes 5.4% available oxygen. It is stable with a wide range of formulating ingredients, and it can be incorporated into commercial and industrial products for long shelf-life. It is a safe non-diluted peroxyacid compound, not sensitive to impact or friction. The pH of a 1% solution of magnesium monoperoxyphthalate hexahydrate is 4.3. Acute oral toxicity (LD 50) is 2.3 g/kg.

In accordance with the preferred embodiments, magnesium monoperoxyphthalate is added to solutions of the carbamate, either the concentrated solutions, often up to 50% concentration, as are used for formulating the treatment baths in textile finishing, or to the more dilute treatment baths themselves which are usually of a concentration of 4–12% of the agent. The magnesium monoperoxyphthalate then reacts with the free formaldehyde present in the solution of carbamate agent, oxidizes the free formaldehyde and effectively removes it from the solution. In the oxidation reaction, formaldehyde is oxidized by the magnesium monoperoxyphthalate from the aldehyde (or methylene glycol as it largely exists in an aqueous solution) to formic acid and thence to carbon dioxide and water.

Even though there are processes which utilize formaldehyde scavengers to decrease free formaldehyde content through an addition or condensation reaction, for example urea, ethyleneurea, dicyandiamide, and the like, these reactions can be reversed to release the scavenged formaldehyde. Unlike such known processes which employ scavengers to decrease free formaldehyde levels, oxidation of formaldehyde with magnesium monoperoxyphthalate as described in the preferred embodiments is not reversible. This reaction is not reversible because the formaldehyde is decomposed, yielding volatile carbon dioxide which terminates the reaction.

Operable conditions for oxidation of free formaldehyde with magnesium monoperoxyphthalate encompass the following range. Concentrations of magnesium monoperoxyphthalate which may be used range from about 0.1% to 10.25% by weight based on the weight of the reaction solution. The preferred concentration is about 2.5%. Magnesium monoperoxyphthalate may be used in solid form or dissolved in water prior to addition to the solution of carbamate agent to be treated. Oxidation may be conducted at temperatures of from about 5° C. to about 90° C.; room temperature is preferred. Time for magnesium monoperoxyphthalate oxidation treatment varies as a function of concentration of oxidant that is employed, temperature, and pH of solution. Effective treatments are accomplished in 1–2 minutes with times of about 60 minutes or less being sufficient under most circumstances. Oxidation of free formaldehyde in carbamate solutions can be conducted with the solution at a pH of from about 4 to about 10. The more effective range is from about pH 6 to about 9 with a pH of about 8 a preferred level. One embodiment of the process shows that it is expeditious to conduct the oxidation at pH 8 and, after oxidation has proceeded to the level desired, to adjust the pH to about 5 or 6 prior to textile treatment with the solution of finishing agent.

An amount of magnesium mono-peroxyphthalate is added to an aqueous solution of a carbamate finishing agent to oxidize the free formaldehyde contained therein. This solution is diluted to the desired concentration used for finishing a cellulosic-containing textile material. About 0.5 to about 4% of a catalyst is added to the solution which is used as the padding bath in the treatment to produce durable press properties in the textile material. Catalysts which promote curing including mineral acids; organic acids; various salts of strong acids such as ammonium salts; alkanolamine salts; metallic salts of strong acids and weak bases, such as zinc nitrate and magnesium chloride; and combinations of the above.

This treatment solution of the carbamate agent and catalyst is applied to a cellulosic-containing fabric by immersing fabric into solution and passing the saturated fabric through squeeze rolls to give a wet pickup of treatment solution of about 60–100% in fabric. Alternatively, low wet pickup (sometimes called minimum add-on) techniques of application may also be employed, such as by kiss roll, foam finishing, loop padding, spraying, printing, and other methods known in the art. In these cases, the amount of wet pickup may be as low as 20–25%, and concentrations of finishing bath are adjusted accordingly.

Curing in which reaction between the carbamate finishing agent and the cellulosic-containing textile occurs is carried out by conventional procedures. The wet, impregnated textile is dried at an elevated temperature, for example, 60°–75° C. for about seven minutes, then further heated to effect the curing. Wrinkle resistance, easy-care, and durable press properties are produced in the cellulosic textile by curing at 120°–240° C., or even higher, for from about 0.25 to about 10 minutes with time and temperature inversely adjusted.

In another embodiment of this invention, fabric already finished with carbamate agent is in the prior art can be aftertreateed with an aqueous solution of the oxidant (magnesium monoperoxyphthalate) to give decreased levels of formaldehyde release from the finished fabric. In this embodiment, aftertreatment can be carried out in several ways: agitation of the carbamate-finished fabric in a solution containing the oxidant; a pad-set batch processing method in which the carbamate-finshed fabric is immersed in a solution of the oxidant, padded to squeeze the solution into the fabric and to adjust the pickup of the solution, and batched or held in this wet, impregnated state for a period of time; and, a pad/dry processing method in which the carbamate-finished is immersed in a solution of the oxidant, padded to squeeze the solution into the fabric and to adjust the pickup of the solution, and dried.

Concentrations of magnesium monoperoxyphthalate which may be used range from about 0.1% to about 10.25% by weight. Oxidation may be conducted at temperatures of from about 5° C. to about 90° C., with temperatures dependent on method of aftertreatment. Time for the magnesium monoperoxyphthalate oxidation treatment varies with the method of after treatment. Oxidation of free formaldehyde in the finished fabric can be conducted at a pH of from about 4 to about 10. The more effective range is from about pH 6 to about pH 9.

The preferred embodiments of this invention relate to the treatment of any hydrophilic fibrous cellulosic textile material. Said materials include cotton, linen, ramie, jute, regenerated cellulose, polynosic rayons, and others. Combinations of these cellulosics and combinations of said cellulosics with other fibers such as polyesters, nylon, acrylics, and the like also can be treated.

Textiles treated accordingly are wrinkle resistant, and have smooth drying properties. That is, textiles so treated require little or no ironing to maintain a smooth appearance after washing and remain smooth during wear after garment fabrication. These textiles have low free formaldehyde and thus do not cause discomfort during the finishing treatment. After treatment, these finished fabrics have low levels of free formaldehyde as well as low levels of formaldehyde release both in the unwashed and washed state.

The following examples are given as illustrations of the invention, and are not intended to limit its scope. All percentages given are percentages by weight of the total solution.

EXAMPLES 1-4

Isopropyl bis(hydroxymethyl) carbamate (DMIPC) was prepared as described in U.S. Pat. No. 4,488,878 as a 59.7% solution. The free formaldehyde content was 7.4%. Portions of the DMIPC solution were treated at room temperature with magnesium monoperoxyphthalate at pH levels of 6, 7, 8, and 9. Magnesium monoperoxyphthalate was used at a concentration equimolar to that of the free formaldehyde (0.0474 g of magnesium monoperoxyphthalate per 0.0030 g of free formaldehyde). Two ml of the solution were diluted to 100 ml, and 1 ml aliquots were withdrawn immediately and after one hour. The aliquots were analyzed for free formaldehyde with Nash reagent (aqueous acetylacetone, ammonium acetate-acetic acid solution). The changed formaldehyde concentrations of the solutions, expressed as the percentage decrease in free formaldehyde content, were: pH 6, −36%; pH 7, −73%, pH 8, −84%; and pH 9, −86%. These examples show that free formaldehyde contents of concentrated solutions of carbamate agents are decreased effectively by oxidation of the contained free formaldehyde with magnesium monoperoxyphthalate.

EXAMPLES 5-7

Isopropyl bis(hydroxymethyl) carbamate (DMIPC) solution of 59.7% concentration was treated with magnesium monoperoxyphthalate at pH 6, 8, and 9 as in Examples 1-4. Aliquots of the solutions were withdrawn periodically for analysis to observe the effect of time of oxidation on free formaldehyde in the DMIPC solution. Results expressed as the percentage decrease in free formaldehyde contents are listed in Table I. These examples show that the decrease of free formaldehyde in concentrated solutions of carbamate agents by oxidation of the contained free formaldehyde with magnesium monoperoxyphthalate proceeds with time and is a funciton of the pH of the solution during oxidation.

TABLE I

| | % Decrease in free formaldehyde content | | |
|---|---|---|---|
| Time (minutes) | pH 6 | pH 8 | pH 9 |
| 5 | −4 | −20 | −36 |
| 15 | −9 | −45 | −61 |
| 35 | −25 | −69 | −79 |
| 65 | −36 | −86 | −90 |
| 90 | −42 | −91 | −91 |
| 120 | −47 | — | — |
| 20 hr. | −70 | — | — |

EXAMPLE 8

Two concentrations of magnesium monoperoxyphthalate (5.13% and 10.25 %) were used as a pad bath additive to oxidize free formaldehyde in treatment solutions containing 9% isopropyl bis(hydroxymethyl) carbamate (DIMPC) and 2.7% magnesium chloride/citric acid (20:1) catalyst. Results were compared to a similar pad bath without oxidant. Results are reported in Table II. They show that use of magnesium monoperoxyphthalate as a pad bath additive effectively decreased the free formaldehyde content of solutions of carbamate agents at conventional treatment bath concentrations.

TABLE II

| Treatment Bath | % Free HCHO | % Decrease in Free HCHO |
|---|---|---|
| 9% DMIPC/catalyst | 0.78 | — |
| 9% DMIPC/catalyst and 5.13% magnesium monoperoxyphthalate | 0.30 | −62 |
| 9% DMIPC/catalyst and 10.25% magnesium monoperoxyphthalate | 0.20 | −74 |

EXAMPLES 9-11

Magnesium monoperoxyphthalate (2.5%) was used as a pad bath additive to oxidize free formaldehyde in treatment solutions containing 9% of a.) methyl bis(hydroxymethyl) carbamate (DMMC), b.) methyl bis)methoxymethyl) carbamate (Me-DMMC), or c.) methyl bis(hydroxyethyoxymethyl) carbamate (EG-DMMC) and 2.7% magnesium chloride/citric acid (20:1) catalyst. A similar set was prepared without the oxidant for controls. Results in Table III report free formaldehyde content of the treatment solutions and formaldehyde release values (according to AATCC Test Method 112-1984) of samples of cotton printcloth treated with the solutions. In the fabric treatment, samples were padded to about 90% pickup of the solution, dried for 7 minutes at 65° C., and cured for 3 minutes at 160° C. in ovens with mechanically circulated hot air. Portions of the treated fabrics also were washed with nonionic detergent in deionized water and dried. These examples show that oxidation of the free formaldehyde in pad baths that contain carbamate agents and catalyst by using magnesium monoperoxyphthalate as a pad bath additive substantially decreased the free formaldehyde content of the pad baths. In addition, formaldehyde release from fabrics treated with the oxidized pad baths was substantially lowered (i.e., decreases of about 50% or more in the unwashed state and even greater decreases in the washed, finished fabrics).

TABLE III

| Treatment Bath | With Oxidant | Free HCHO in Pad Bath: % Free HCHO | Free HCHO in Pad Bath: % Decrease in Free HCHO | HCHO Release, μg/g From Treated Fabric: Not Washed | HCHO Release, μg/g From Treated Fabric: Washed |
|---|---|---|---|---|---|
| a. DMMC | No | 0.82 | — | 818 | 140 |
| a. DMMC | Yes | 0.51 | −38 | 415 | 12 |
| b. Me—DMMC | No | 0.77 | — | 896 | 65 |
| b. Me—DMMC | Yes | 0.53 | −31 | 251 | 0 |
| c. EG-DMMC | No | 0.75 | — | 736 | 79 |
| c. EG-DMMC | Yes | 0.50 | −33 | 188 | 35 |

EXAMPLES 12–20

Samples of cotton printcloth were impregnated with solutions containing 9% of a.) isopropyl bis(hydroxymethyl) carbamate (DMIPC); b.) isopropyl bis(methoxymethyl) carbamate (Me-DMIPC); or c.) isopropyl bis(hydroxyethyoxymethyl) carbamate (EG-DMIPC) and 2.7% magnesium chloride/citric acid (20:1) catalyst. The fabrics were dried for 7 minutes at 65° C. and cured for 3 minutes at 160° C. in ovens with mechanically circulated hot air.

Portions of the treated fabrics were then immersed, with agitation, for 15 minutes at room temperature in solutions containing 2.5% magnesium monoperoxyphthalate buffered to pH 6, 7, or 8. The fabrics were rinsed, dried, and formaldehyde release values were determined by the method of AATCC Test 112–1984. Portions of the carbamate treated fabrics without aftertreatment also were analyzed for controls. Results shown in Table IV indicate the effectiveness of the magnesium monoperoxyphthalate oxidation aftertreatemnt to substantially derease formaldehyde release from carbamate-finished fabrics.

TABLE IV

| Fabric Treatment | Formaldehyde Release, μg/g: Not Oxidized | Oxidized by Treatment at: pH 6 | pH 7 | pH 8 |
|---|---|---|---|---|
| DMIPC | 601 | 274 | 236 | 211 |
| Me—DMIPC | 337 | 94 | — | 54 |
| EG-DMIP | 152 | 99 | 27 | 4 |

EXAMPLES 21–29

Portions of the three carbamate-finished fabrics from examples 12–20 were aftertreated with magnesium monoperoxyphthalate by a pad/wet-batch process as follows. Samples of the fabrics were immersed in solutions containing 2.5% magnesium monoperoxyphthalate buffered to pH 6, 7, or 8, padded to adjust the pickup to about 90%, held for 15 minutes at room temperature without drying, rinsed, and dried. Formaldehyde release values of the fabrics are shown in Table V. These results indicate the effectiveness of the pad-wet batch oxidation aftertreatment with magnesium monoperoxyphthalate to give substantially lowered formaldehyde release from carbamate-finished fabrics.

TABLE V

| Fabric Treatment | Formaldehyde Release, μg/g: Not Oxidized | Oxidized by Pad/Wet-Batch Treatment: pH 6 | pH 7 | pH 8 |
|---|---|---|---|---|
| DMIPC | 601 | 319 | 249 | 236 |
| Me—DMIPC | 337 | 144 | 126 | 102 |
| EG-DMIPC | 152 | 78 | 38 | 2 |

EXAMPLES 30–38

Portions of the three carbamate finished fabrics from Examples 12–20 were aftertreated with magnesium monoperoxyphthalate by a pad-dry process as follows. Samples of the fabrics were immersed in solutions containing 2.5% magnesium monoperoxyphthalate buffered to pH 6, 7, or 8, padded to adjust pickup to about 90%, dried by heating in an oven with circulating air for 7 minutes at 65° C., rinsed, and dried. Formaldehyde release values of the fabrics are given in Table VI. They show that a pad/dry oxidation aftertreatment with magnesium monoperoxyphthalate is useful for lowering the formaldehyde release from carbamate-treated fabrics by substantial amounts.

TABLE VI

| Fabric Treatment | Formaldehyde Release, μg/g: Not Oxidized | Oxidized by Pad/Dry Treatment: pH 6 | pH 7 | pH 8 |
|---|---|---|---|---|
| DMIPC | 601 | 214 | 164 | 187 |
| Me—DMIPC | 337 | 125 | 77 | 89 |
| EG-DMIPC | 152 | 48 | 0 | 10 |

We claim:

1. A method of producing a lowered formaldehyde release durable press fabric comprising:
   - oxidizing a solution of a carbamate finishing agent containing free formaldehyde and a durable press catalyst for cellulose with a sufficient amount of magnesium monoperoxyphthalate oxidant to produce a durable press finishing treatment bath having a decreased free formaldehyde content;
   - immersing a cellulose containing fabric in said durable press finishing treatment bath; and then,
   - drying and curing said cellulose containing fabric for sufficient time and temperature to produce durable press and low formaldehyde release properties in the fabric.

2. The method of claim 1 wherein the padded fabric is cured for from about 120° C. to 240° C. for from about 0.25 to about 10 minutes, time and temperature being inversely adjusted and the concentration of carbamate finishing agent in the pad bath is from about 4% to 12%.

3. A method of producing a lowered free formaldehyde release carbamate durable press finished fabric comprising immersing a high free formaldehyde release carbamate durable press finished fabric in a solution of magnesium monoperoxyphthalate oxidant of sufficient concentration of sufficient time and temperature to oxidize the free formaldehyde and thereby produce a lowered free formaldehyde release carbamate durable press finished fabric.

4. The method of claim 3 wherein the concentration of magnesium monoperoxyphthalate oxident is 0.1 to 10.25% and the temperature is from about 5° to 90° C. for from about 1 to 60 minutes at a pH of from about 6 to 9.

5. A method of producing a concentrated carbamate finishing agent solution of lowered free formaldehyde content comprising oxidizing a carbamate finishing agent solution containing free formaldehyde with a sufficient amount of magnesium monoperoxyphthalate oxidant to decrease the free formaldehyde content of the solution.

6. The method of claim 5 wherein the carbamate finishing agent solution is prepared from the reaction of an alkyl or alkoxyalkylcarbamate and formaldehyde.

7. The method of claim 6 wherein the alkyl or alkoxyalkyl group contains less than 6 carbon atoms.

8. The method of claim 7 wherein the amido moiety contains hydroxymethyl, methoxymethyl or hydroxyethoxymethyl.

9. The method of claim 7 wherein the concentration of magnesium monoperoxyphthalate is from about 0.1% to 10.25% by wt of solution and the pH is from about 6 to 9.

10. A method for producing a lowered free formaldehyde durable press finishing treatment bath for cellulose containing fabric comprising oxidizing a solution of a carbamate finishing agent containing free formaldehyde and a durable press catalyst for cellulose with a sufficient amount of magnesium monoperoxyphthalate oxidant to decrease the free formaldehyde content of said solution.

11. The method of claim 10 wherein the durable press catalyst for cellulose is selected from the group consisting of mineral acids. organic acids, salts of strong acids, alkanolamine salts, metallic salts of strong acids and weak bases such as zinc nitrate and magnesium chloride, and combinations thereof.

12. The method of claim 10 wherein the carbamate finishing agent solution is prepared from the reaction of an alkyl or alkoxyalkylcarbamate and formaldehyde.

13. The method of claim 12 wherein the alkyl or alkoxyalkyl group contains less than 6 carbon atoms and the amido moiety contains hydroxymethyl, methoxymethyl or hydroxyethoxymethyl groups.

14. The method of claim 12 wherein the carbamate concentration is from about 4 to 12% and the magnesium monoperoxyphthalate is from about 0.1 to 10.25% by wt of solution.

* * * * *